US008864423B2

(12) United States Patent
Oliveira

(10) Patent No.: US 8,864,423 B2
(45) Date of Patent: Oct. 21, 2014

(54) GEOMEMBRANE PROTECTIVE COVER

(75) Inventor: Paul Oliveira, Carmel, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 426 days.

(21) Appl. No.: 12/349,927

(22) Filed: Jan. 7, 2009

(65) Prior Publication Data

US 2009/0175687 A1 Jul. 9, 2009

Related U.S. Application Data

(60) Provisional application No. 61/019,389, filed on Jan. 7, 2008.

(51) Int. Cl.
*E02B 3/12* (2006.01)
*E02D 17/20* (2006.01)

(52) U.S. Cl.
CPC ..... *E02D 17/202* (2013.01)
USPC ..... 405/270; 405/53

(58) Field of Classification Search
USPC ..... 405/270, 265, 268, 16–19, 107, 116, 405/117, 129.6, 129.75, 302.4, 302.6, 405/302.7, 53, 55, 57; 428/78, 147, 206, 428/331, 423.1, 907, 195.1, 425.5, 424.8, 428/189, 190, 143, 150, 323; 4/498, 501, 4/503
See application file for complete search history.

(56) References Cited

U.S. PATENT DOCUMENTS 2,333,287 A * 11/1943 Baird ..... 405/265
3,280,082 A 10/1966 Natta et al.
3,474,625 A * 10/1969 Bennett et al. ..... 405/270
3,949,113 A * 4/1976 Draper et al. ..... 442/86
3,965,051 A 6/1976 Markusch et al.
4,025,466 A 5/1977 Jourquin et al.
4,125,983 A * 11/1978 Jarrell ..... 52/741.12
4,501,788 A * 2/1985 Clem ..... 405/107
4,678,375 A 7/1987 Gagle
4,732,925 A 3/1988 Davis
4,810,565 A 3/1989 Wasitis et al.
4,896,453 A * 1/1990 Jacob ..... 47/9
4,981,880 A 1/1991 Lehmann et al.
5,054,327 A 10/1991 Gould
5,090,154 A * 2/1992 Jacob ..... 47/9
5,091,234 A * 2/1992 McGroarty et al. ..... 428/143
5,162,436 A 11/1992 Davis et al.
5,175,228 A 12/1992 Wang et al.

(Continued)

FOREIGN PATENT DOCUMENTS

DE 1946469 B * 3/1971
EP 304711 B * 3/1991

(Continued)

*Primary Examiner* — Sunil Singh

(74) *Attorney, Agent, or Firm* — Jason A. Houser; Arthur M. Reginelli

(57) ABSTRACT

A pond liner system includes a geomembrane liner (12), a binder (22) and a particulate (24). The geomembrane liner (12) has a submerged portion (14), an exposed portion (15) and an anchor portion (16). The binder (22) adheres to the exposed portion (15) of the geomembrane liner, and the particulate (24) adheres to the binder (22). A method of applying a protective cover to the exposed portion (15) of the geomembrane liner includes spraying the binder (22) onto the liner (12), allowing the binder (22) to partially cure, and spreading the particulate (24) over the partially cured binder (22).

12 Claims, 2 Drawing Sheets

(56) References Cited

U.S. PATENT DOCUMENTS

| | | | | | |
|---|---|---|---|---|---|
| 5,204,148 | A | | 4/1993 | Alexander et al. | |
| 5,221,570 | A | | 6/1993 | Gokcen | |
| 5,242,970 | A | | 9/1993 | Davis et al. | |
| 5,256,228 | A | | 10/1993 | Davis et al. | |
| 5,258,217 | A | * | 11/1993 | Lewis | 428/120 |
| 5,260,111 | A | | 11/1993 | Valaitis et al. | |
| 5,286,798 | A | | 2/1994 | Davis et al. | |
| 5,288,168 | A | * | 2/1994 | Spencer | 405/54 |
| 5,370,755 | A | | 12/1994 | Davis et al. | |
| 5,389,715 | A | | 2/1995 | Davis et al. | |
| 5,512,118 | A | | 4/1996 | Davis et al. | |
| 5,582,890 | A | | 12/1996 | Davis et al. | |
| 5,700,538 | A | | 12/1997 | Davis | |
| 5,854,327 | A | | 12/1998 | Davis et al. | |
| 5,905,151 | A | | 5/1999 | Slack et al. | |
| 5,985,981 | A | | 11/1999 | Alexander et al. | |
| 6,755,596 | B2 | * | 6/2004 | Schibi | 405/270 |
| 7,205,374 | B2 | | 4/2007 | Fieldhouse et al. | |
| 2007/0283999 | A1 | | 12/2007 | Yektiely | |

FOREIGN PATENT DOCUMENTS

| | | | | |
|---|---|---|---|---|
| JP | 55148825 | A | * | 11/1980 |
| JP | 57029718 | A | * | 2/1982 |
| JP | 58047812 | A | * | 3/1983 |
| JP | 61010611 | A | * | 1/1986 |
| JP | 11269314 | A | * | 10/1999 |
| WO | WO 2007029277 | A1 | * | 3/2007 |

* cited by examiner

GEOMEMBRANE PROTECTIVE COVER

This application gains the benefit of U.S. Provisional Application No. 61/019,389, filed Jan. 7, 2008, which is incorporated herein by reference.

FIELD OF THE INVENTION

This invention relates generally to geomembrane pond liner systems. In particular, this invention relates to a geomembrane pond liner having a covering on a portion of the membrane.

BACKGROUND OF THE INVENTION

Geomembrane lining systems are used for a variety of decorative and containment applications, including ponds for both commercial and residential uses, waterfalls, streams, irrigation canals, storm water retention ponds, agricultural pits and ponds, and aquaculture applications. The wide use of geomembrane lining systems over the alternative liners made of soil, clay, concrete and steel may be attributable to the many advantages of the system over these other available options. These advantages may include secure water containment, enhanced water quality control, cleaning and disinfection capabilities, erosion protection, rapid and easy installation, low maintenance costs, long life and easy repairs.

Geomembrane liners are typically installed with the geomembrane liner extending over the bank of the pond, stream, or other water body, and may extend into a trench that runs along the bank to thereby anchor the liner in place. The anchor portion of the liner acts to ensure that the weight of the water will not pull the geomembrane liner out of its desired position. This installation method results in an exposed portion of the geomembrane liner extending from the water surface over the bank to the point where the liner is buried beneath the earth in the anchor trench.

The exposed portion of the geomembrane liner may either be left exposed or covered with another material. In certain applications the aesthetics of the water body being created are extremely important and therefore it is a necessity that the exposed liner be covered. For example, in applications such as residential ponds or streams, and in water bodies in parks or on golf courses, it is extremely important that the resulting product appear as natural as possible.

In commercial applications such as water treatment facilities and storm water retention ponds, where aesthetics may not be as important, the geomembrane liner is often left uncovered. Even in these types of commercial applications, however, there are advantages to covering the exposed portion of the geomembrane liner.

The exposed portion of a geomembrane liner is subjected to harsh environmental conditions that covered portions of the liner are not. For example, an exposed portion of the liner is subject to UV rays from the sun, wind and flying debris, as well as hail and other precipitation. In addition, the exposed portion of the liner may be punctured, cut or torn by animal claws, teeth, or beaks. In particular, it has been found that birds such as ducks and geese tend to peck at exposed geomembrane liners. It has also been found that large hoofed animals such as deer or cattle can puncture the geomembrane liner when approaching a pond to drink. Another consideration when installing a pond with a geomembrane lining system is the safety of the animals that may drink from or swim in the water body created by the geomembrane liner. The liner can become slippery, and animals that voluntarily enter the water, or animals that fall into the water as a result of the slippery liner, may have trouble getting out of the water and over the bank if the liner is left uncovered.

Current industry practice to cover exposed liners includes covering the exposed liner with large rocks and dirt. Although the rocks and dirt may initially provide adequate coverage of the exposed liner, this solution is often temporary and typically requires maintenance or reapplication after a period of time. The loosely applied rocks have a tendency to shift or slide down the steeper portion of the bank where the exposed geomembrane liner is typically located. Dirt also has a tendency to slide down the bank and will erode over time as well.

Thus, there is a need in the art for a geomembrane lining system having a protective covering over the exposed portion of the geomembrane liner that will not erode or slide down the slope of the bank. There is also a need for a lining system having a protective covering that will provide friction on the surface thereof to permit animals to safely approach, enter, and exit the water body.

SUMMARY OF THE INVENTION

In one or more embodiments the present invention relates to a geomembrane protective cover having a urethane binder layer and a fine particulate layer, the urethane binder layer being affixed on a first side to a geomembrane liner by the adhesive properties of the urethane binder, and the urethane layer being affixed on a second side to the fine particulate layer by the adhesive properties of the urethane binder.

In one or several other embodiments the present invention relates to a pond lining system having a geomembrane liner with a base portion, an intermediate portion, and an anchor portion, a urethane binder layer and a fine particulate layer. The urethane binder layer is affixed on a first side to the intermediate portion of the geomembrane by the adhesive properties of the urethane binder, and the urethane binder layer is affixed on a second side to the fine particulate layer by the adhesive properties of the urethane binder.

In still other embodiments of the present invention a method of installing a protective cover is disclosed. The protective cover is installed over an intermediate portion of a geomembrane liner, the process including: applying a urethane binder on the intermediate portion of the geomembrane liner; allowing the urethane binder to cure until it is tacky; spreading a fine particulate composition over the tacky urethane binder; and allowing the urethane binder to dry.

DETAILED DESCRIPTION OF ILLUSTRATIVE EMBODIMENTS

One or more embodiments of the present invention are directed toward geomembranes having a particulate coating affixed to a portion of the geomembrane. In one or more embodiments, the geomembranes are a component of a water containment system. In one or more embodiments, a binder is adhered to at least a portion of the upper surface of a geomembrane, and particulate is embedded in the binder or adhered to the membrane by the binder. In one or more embodiments, the binder and particulate provide a protective cover over a portion of the upper surface of the geomembrane liner.

Figure 1:
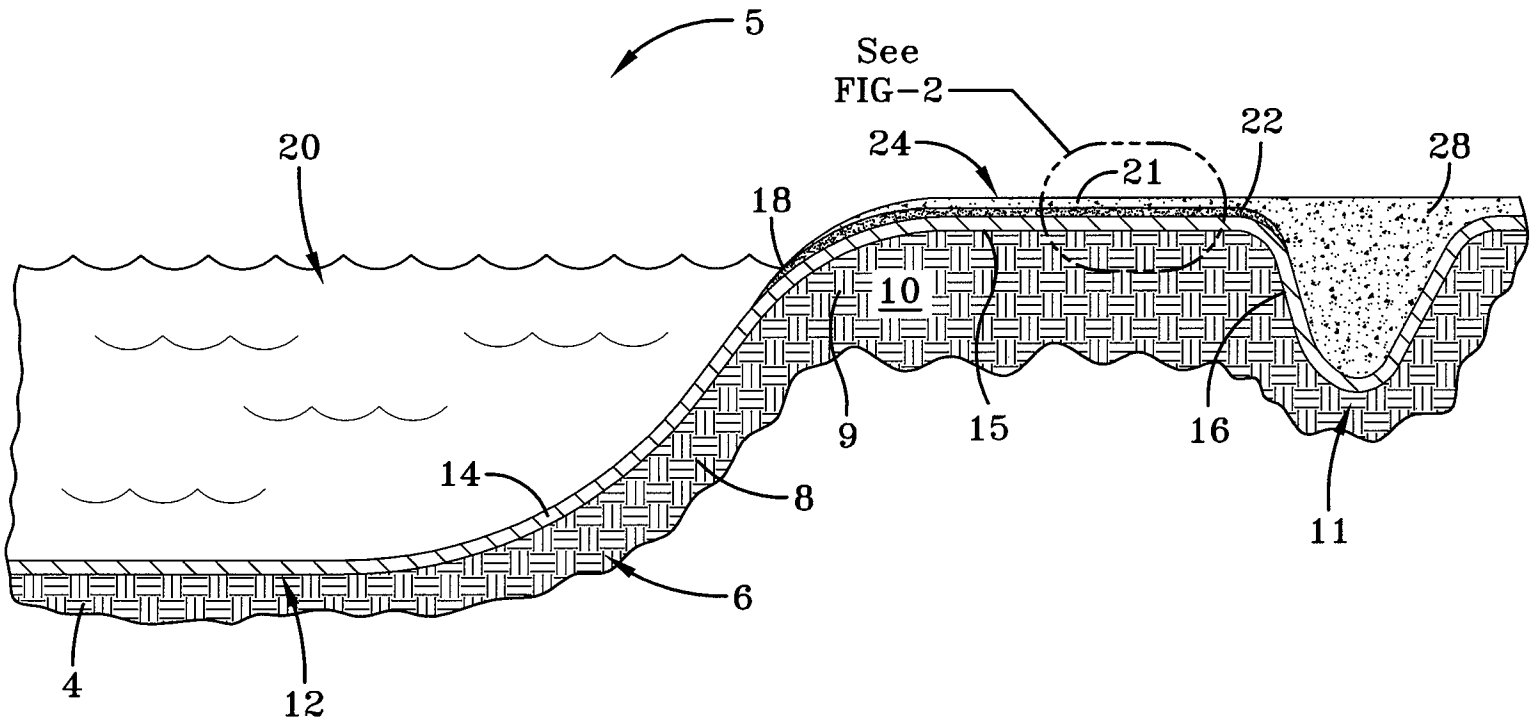
FIG. 1 is a cross sectional view of a pond having a geomembrane pond liner system according to one or more embodiments.

A water containment system according to one or more embodiments of the present invention is shown in FIG. 1. Water containment system 5 includes a basin 6 located within the ground 10. Water 20 may be contained within basin 6. Basin 6 includes bottom 4, sloped walls 8 (which may extend around basin 6), and a bank 9 at the transition between sloped walls 8 and the surrounding ground surface. Waterline 18 is the point at which water 20 meets bank 9.

Geomembrane 12 is positioned within basin 6 and extends at least to bank 9. In the embodiment shown, geomembrane 12 extends beyond basin 6, over bank 9, and into an anchor trench 11. Anchor trench 11 may be formed by digging a ditch at a desired depth and distance from waterline 18 (or the anticipated waterline). The distance and depth may depend on the size of the water containment system 5. Trench 11 includes overfill 28 that acts to anchor liner 12 in place. Overfill 28 may include dirt that was excavated to make trench 11.

Geomembrane 12 may be described with respect to regions or areas as it is positioned within basin 6. For example, geomembrane 12 may include a base portion 14, an anchor portion 16, and an upper portion 15. Base portion 14 is the portion of liner 12 that is positioned on bottom 4, and may include all or part of geomembrane 12 that is positioned over sloped walls 8 of pond basin 6. Anchor portion 16 is positioned within anchor trench 11 and is covered by overfill 28, thereby securing geomembrane liner 12 in place. In one or more embodiments, upper portion 15 generally extends between base portion 14 and anchor portion 16. A particulate coating 24 is affixed to upper portion 15, and is described in greater detail below.

It should be appreciated that upper portion 15 includes at least that portion of the liner 12 that is likely to be exposed when the pond 5 is filled to the intended depth, but may also include portions of liner 12 extending below waterline 18 and under overfill 28 so that parts of the liner 12 will not later be exposed due to water level fluctuation or erosion of overfill 28. Upper portion 15 may also include all or part of geomembrane 12 that covers bank 8 of system 5, and that is likely to be submerged under water when system 5 is filled with water 20. The size of upper portion 15, and therefore the amount of geomembrane 12 that is covered by particulate coating 24, may vary depending on the specifications of the particular system being installed.

Practice of the present invention is not necessarily limited by the selection of a particular geomembrane. The geomembrane, which may also be referred to as a pond liner, or simply liner, may include any of those geomembranes currently employed in the art. In one or more embodiments, geomembrane 12 may be a thermoset material. In other embodiments, geomembrane 12 may be a thermoplastic or thermoformable material.

In one or more embodiments, geomembrane 12 may be EPDM (ethylene-propylene-diene-terpolymer) based. In other embodiments, geomembrane liner 12 may be TPO (thermoplastic-olefin) based. In yet other embodiments, geomembrane liner 12 may be PVC (polyvinyl chloride) based. In still other embodiments, geomembrane 12 may be a polypropylene-based sheet. In these or other embodiments, the geomembrane may be flexible and capable of being rolled up for shipment. In these or other embodiments, the geomembrane may include fiber reinforcement. Membrane reinforcement materials are well known to persons having ordinary skill in the art.

Useful EPDM geomembranes include those that are conventional and commercially available in the art. For example, EPDM geomembranes are commercially available under the tradename PONDGARD from the Firestone Specialty Products Company, LLC (Carmel, Ind.). Also, EPDM geomembranes are disclosed in numerous United States patents including U.S. Pat. Nos. 3,280,082, 4,732,925, 4,810,565, 5,162,436, 5,286,798, 5,370,755, 5,242,970, 5,512,118, 2,260,111, 5,256,228, 5,582,890, 5,204,148, 5,389,715, 5,854,327, 5,054,327, and 5,700,538, which are incorporated herein by reference for the purpose of teaching suitable geomembranes for the pond lining system of the present invention. Useful TPO membranes are available under the tradename ULTRAPLY™ TPO, and useful PVC membranes are available under the tradename ULTRAPLY™ PVC. Useful flexible polypropylene sheets are available under the tradename MultilLiner RPP (Firestone Specialty Products).

Figure 2:
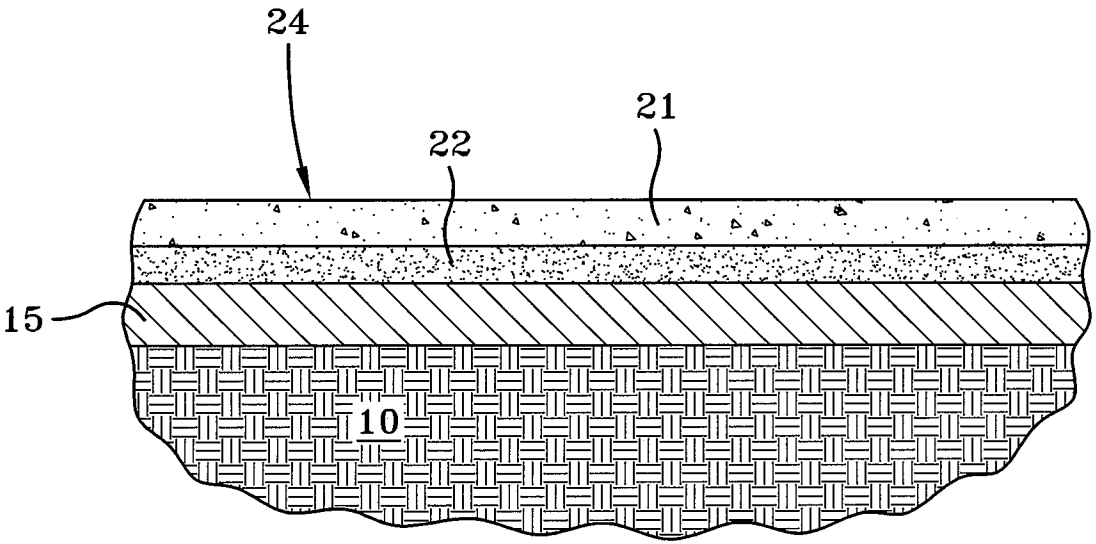
FIG. 2 is an enlarge view of a portion of the geomembrane pond liner system as indicated in FIG. 1.

In one or more embodiments, the particulate coating 24 includes a particulate 21 and a binder 22. In one or more embodiments, the binder 22 serves to adhere the particulate 21 to the geomembrane. In one or more embodiments, the binder 22 serves as a matrix for at least a portion of the particulate 21. In one or more embodiments, the binder 22 does not completely encapsulate all of the particulate 21 so that at least a portion of the particulate is exposed along the surface of the particulate coating opposite the surface where the particulate coating 24 contacts the membrane. In one or more embodiments, the binder 22 is adhered to an upper surface of upper portion 15 of geomembrane liner 12, and the particulate 21 is deposited on the binder. Particulate 21 and binder 22 are shown in FIGS. 1 and 2 as being separate and distinct layers for simplicity purposes only, and the present invention should not be so limited, as discussed herein.

In one or more embodiments, the binder includes a polyurethane and/or polyisocyanurate. The polyurethane may derive from a one-part urethane system, or it may derive from a two-part urethane system.

Urethane binders have a number of advantageous properties for use in conjunction with the pond lining system. Urethanes are abrasion and impact resistant and have good capacity for load bearing and flexing. Urethanes also have good bonding properties, which are desirable for affixing the binder to geomembrane liner 12, as well as particulate 24. In addition, urethanes are stable in harsh environmental conditions, which may be required where the pond liner systems are installed in regions subject to harsh environmental conditions.

Useful polyurethane binder systems include those known in the art including those disclosed in U.S. Pat. Nos. 7,205,347, 3,965,051, 4,025,466, 4,981,880, 5,175,228, 5,905,151, and 5,985,981, which are incorporated herein by reference for the purpose of teaching polyurethane binder systems.

Particulate 24 is adhesively attached or secured to binder 22 by the adhesive or binding properties of the binder. In one or more embodiments, the particulate 24 is embedded within and is substantially surrounded by binder 22. In another embodiment, particulate 24 is secured or adhered to the top surface of binder 22 and is not surrounded by binder 22.

Particulate should be interpreted in its broadest sense, and should be read to include any solid matter in particle or granular form. In one or more embodiments, the particulate includes a material capable of providing a textured surface to at least a portion of the surface of the geomembrane. This surface may advantageously allow animals to enter and exit the water contained in the geomembrane liner. This surface may also advantageously protect the geomembrane from punctures, tears or cuts from the hoofs, claws or beaks of animals. In one or more embodiments, the particulate includes fine particulate, which may allow for ease of installation and to provide for a smoother surface.

In one or more embodiments, the particulate may include sand, rock, gravel, crushed gravel, crushed stone, earth, soil, or a combination of two or more thereof. For ease of description, one or more of the foregoing may be referred to as dirt. The use of dirt is advantageous because it is low cost and because it provides a natural look and feel to the protective cover.

In one or more embodiments, the dirt includes at least 25% by weight sand, which generally refers to silica-based materials. In one or more embodiments, these silica-based materials have a particulate size from about 0.05 to about 2 mm.

In one or more embodiments, the dirt may include local dirt taken from excavation sites within the immediate geographic area, or from the site of the pond itself. Local dirt may provide a more natural look and feel to the particulate coating when finished, and also will prevent the importation of harmful bacteria from remote geographic regions.

In one or more embodiments, the present invention also provides a method of installing a particulate coating over an upper portion of a geomembrane. The method includes applying a binder on a portion of the geomembrane, allowing the binder to cure until it becomes tacky or adhesive, applying particulate over the tacky binder; and allowing the binder to dry completely.

In one or more embodiments, the binder may be applied to a portion of the geomembrane by spraying. Conventional apparatus for spray applying polyurethane compositions may be employed. In one or more embodiments, the binder 22 may be sprayed at a rate between approximately 140 to 180 square feet per gallon, and in other embodiments may be sprayed at a rate of approximately 160 square feet per gallon. In one or more embodiments, the binder may be applied to the geomembrane by employing other techniques such as brushing or rolling. For example, the binder composition can be rolled onto the intended surface by using a thick nap roller.

As those skilled in the art will appreciate, the binder is advantageously applied to a portion of the membrane that would otherwise be exposed once the water containment system has water introduced thereto. For example, the binder (and ultimately the particulate) can be applied at least between the anticipated water level line 18 and the anchor trench 11.

In one or more embodiments, the particulate may be spread or distributed over binder 22 once binder 22 has become tacky or adhesive. Particulate 24 becomes adhered to partially cured binder 22 as a result of its adhesive properties. In one or more embodiments, curing of the urethane binder may be accelerated by applying a light mist of water to the urethane binder. Those skilled in the art will be able to readily determine a sufficient amount of time necessary to allow the binder to develop enough green strength or tackiness so that the particulate can be applied and efficiently adhered to the binder.

The particulate may be spread manually over binder 22. In one or more embodiments, particulate 24 may be spread with the use of a blowing device. The blowing device may be any device capable of blowing particulate 24 over and onto binder 22. For example, a conventional leaf blower can be used to blow dirt near or adjacent to the geomembrane onto the binder.

In one or more embodiments, the final step of the installation process for the protective cover may be to allow the binder to cure completely after the particulate has been spread over it. Allowing the binder to completely cure before permitting human or machine traffic over the protective cover, or subjecting the protective cover to water, ensures that the particulate will not be dislodged. The result is a durable protective cover for the exposed portion of a geomembrane pond liner that may also provide a frictional surface for the safety of wildlife.

It should be appreciated that the above described method of installing a particulate coating may be a part of the complete installation of a water containment system 5, or may be performed subsequent to the water containment system installation (e.g. existing containment systems). Installation of water containment system 5 typically involves a number of steps, including excavating a basin 6, although an existing basin may be utilized in some cases. In one or several embodiments an anchor trench 11 may also be excavated around basin 6, although such a trench is not critical. Geomembrane liner 12 is then placed within basin 6 and is formed to the shape of the basin, extending over the bank 9 of basin 6 and into anchor trench 11 if such a trench has been provided. Once in place, overfill 28 is provided over a portion of geomembrane liner 12 to secure it in place. Basin 6 may then be filled with water or other liquid up to the level desired. The process of installing a particulate coating may occur at any point in the process of installing the water containment system after the geomembrane liner 12 has been placed in basin 6.

Various modifications and alterations that do not depart from the scope and spirit of this invention will become apparent to those skilled in the art. This invention is not to be duly limited to the illustrative embodiments set forth herein.

What is claimed is:

1. A pond lining system for use in a basin located within the ground, wherein the basin includes a bottom, sloped walls, and a bank which provides a transition between the sloped walls and a surrounding ground surface, the pond lining system comprising:

a polymeric geomembrane liner having a base portion adapted to be positioned within the basin and wherein the base portion is below a water surface when water is received in the basin, an intermediate portion adapted to be positioned on the bank which is above the water surface and substantially parallel thereto, and an anchor portion adapted to be positioned below ground and spaced from the base portion by said intermediate portion;

a urethane binder layer adhesively secured over and to the intermediate portion of the geomembrane liner and above the water surface when water is received in the basin, the base portion and the anchor portion being substantially devoid of said urethane binder layer, said urethane binder layer disposed in a uniform and uninterrupted layer; and a particulate embedded in the urethane binder layer, the particulate being a mixture of dirt and sand.

2. The pond lining system of claim 1 where said intermediate portion is positioned between said base portion and said anchor portion so that said anchor portion is positioned away from the base portion.

3. A pond lining system for use in a basin located within the ground, wherein the basin includes a bottom, sloped walls and a bank which provides a transition between the sloped walls and a surrounding ground surface, the pond lining system comprising:

a polymeric geomembrane liner having a base portion adapted to be positioned in the basin and below water received in the basin, an exposed intermediate portion, and an anchor portion adapted to be positioned below ground and spaced from the base portion, said exposed intermediate portion adapted to be positioned between said base portion and said anchor portion so that said anchor portion is adapted to be positioned away from the water and so that said exposed intermediate portion is on the bank and above the water surface and substantially parallel with the bank;

a urethane binder layer; and a fine particulate layer, wherein a first side of said urethane binder layer is affixed to said exposed intermediate portion of said geomembrane liner by adhesive properties of the urethane binder layer so that said urethane binder layer is positioned primarily on said exposed intermediate portion and in a uniform and uninterrupted layer, wherein a second side of said urethane binder layer is affixed to said fine particulate layer by the adhesive properties of the urethane binder layer, and wherein said base portion and said anchor portion are substantially devoid of said urethane binder layer.

4. The pond lining system of claim 3 where said fine particulate layer is a dirt and sand composition.

5. The pond lining system of claim 4 where said dirt and sand composition is at least twenty-five percent sand.

6. The pond lining system of claim 3 where the polymeric geomembrane liner is a thermoplastic membrane.

7. The pond lining system of claim 3 where the polymeric geomembrane liner is a thermoset membrane.

8. The pond lining system of claim 3 where a portion of said urethane binder layer extends toward said base portion.

9. A method of installing a geomembrane liner used in a basin located within the ground, wherein the basin includes a bottom, sloped walls and a bank which provides a transition between the sloped walls and a surrounding ground surface, the pond lining system comprising:

positioning the geomembrane liner in a desired location, the geomembrane liner including a top surface and a base portion, an intermediate portion, and an anchor portion;

spraying a urethane binder on the top surface of the intermediate portion of said geomembrane liner so as to form a uniform binder layer, and leaving the top surface of said base portion and said anchor portion devoid of said urethane binder;

allowing said urethane binder layer to partially cure so that it is tacky;

distributing a particulate over said urethane binder layer by using a blowing device;

allowing said urethane binder layer to fully cure and bond to said top surface of the intermediate portion and said particulate;

covering the anchor portion of said geomembrane liner with soil; and covering the base portion of said geomembrane liner with water so that a substantial portion of said intermediate portion and said particulate with said binder is above the water and substantially parallel thereto.

10. The method of claim 9 where said particulate is a dirt and sand composition.

11. The method of claim 9 where the anchor portion is positioned away from the base portion.

12. The method of claim 9 wherein covering the base portion of said geomembrane liner with water so that a portion of said intermediate portion and said particulate with said urethane binder layer extends below the water.

* * * * *